US006690256B2

(12) United States Patent
Ohashi et al.

(10) Patent No.: US 6,690,256 B2
(45) Date of Patent: Feb. 10, 2004

(54) COIL DEVICE

(75) Inventors: Yasuo Ohashi, Tokyo-to (JP); Jun Nagai, Sagamihara (JP); Tadahiko Matsumoto, Yokohama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 22 days.

(21) Appl. No.: 10/125,556

(22) Filed: Apr. 19, 2002

(65) Prior Publication Data

US 2002/0158742 A1 Oct. 31, 2002

(30) Foreign Application Priority Data

Apr. 27, 2001 (JP) ..... 2001-132367

(51) Int. Cl.[7] ..... H01F 5/00

(52) U.S. Cl. ..... 336/200; 336/197; 336/210; 336/212

(58) Field of Search ..... 336/200, 232, 336/212, 134, 165, 100

(56) References Cited

U.S. PATENT DOCUMENTS 5,321,380 A * 6/1994 Godek et al. ..... 336/232
5,929,382 A * 7/1999 Moore et al. ..... 174/72 TR
6,028,500 A 2/2000 Buist
6,147,583 A * 11/2000 Rinne et al. ..... 336/200
6,281,779 B1 * 8/2001 Matsumoto et al. ..... 336/200
6,326,875 B1 * 12/2001 Tuovinen ..... 336/197
6,565,382 B1 * 5/2003 Blodgett et al. ..... 439/547

FOREIGN PATENT DOCUMENTS

EP 1 168 385 A1 1/2002
JP 9293944 * 11/1997 ..... 336/200

* cited by examiner

*Primary Examiner*—Ahn Mai
(74) *Attorney, Agent, or Firm*—Keating & Bennett, LLP

(57) ABSTRACT

In order to improve efficiency of core rubbing operation and also to facilitate reduction in thickness of a coil device, a core-combining member includes substantially U-shaped topside and backside cover members, and a pair of core members are clamped and combined together from top and backsides by fitting the topside and backside cover members to each other. Legs of the topside cover member are provided with leg-openings formed therein while legs of the backside cover member are provided with convex parts for retaining to edges of the leg-openings so as to prevent detachment. A play clearance in the front and rear direction is provided between the convex part and an edge of the leg opening. Core rubbing is performed by relatively moving the cover members in the front and rear direction so as to integrally move the core members while maintaining the core members to be clamped. Stopper means is provided for restricting the relative displacement in the front and rear direction.

20 Claims, 8 Drawing Sheets

COIL DEVICE

BACKGROUND OF THE INVENTION

1. Field of the Invention

The present invention relates to a coil device functioning as a transformer or choke coil.

2. Description of the Related Art

FIG. 10A shows an exploded view of a conventional coil device. FIG. 10B shows a sectional view at the line A—A of the coil device shown in FIG. 10A. A coil device 1 shown in FIGS. 10A and 10B functions as a transformer or choke coil provided in a circuit such as a DC—DC converter and includes a substrate 2 for mounting an electronic component, a coil pattern section 3 provided on the substrate 2, a pair of core members 4*a* and 4*b*, and a core combining member 5.

On the substrate 2, electronic components defining a circuit are provided along with a circuit pattern. The substrate 2 is a multi-layered substrate defined by depositing a plurality of substrates on each other, and each substrate defining the substrate 2 has a coil pattern 7 provided coaxially about a central axis. The plurality of coil patterns 7 define a coil pattern section 3. In addition, when the coil device 1 defines a transformer device, among the plurality of coil patterns 7, at least one coil pattern 7 defines a primary coil while the others define secondary coils.

In this conventional example, both of the pair of core members 4*a* and 4*b* are made by pressing and sintering magnetic material powder such as ferrite, and are E-shaped core members having an E-shaped section and including a flat top-plate portion 8 and core legs 9*a*, 9*b*, and 9*c* extending from the center and bilateral ends of the top-plate portion 8.

On the substrate 2, core-leg insertion holes 10*a*, 10*b*, and 10*c* are provided at a position of the substrate located in the central portion of the coil pattern section 3 and at positions of the substrate located outside the coil pattern section 3, respectively. Into these core-leg insertion holes 10*a*, 10*b*, and 10*c*, the respective core legs 9*a*, 9*b*, and 9*c* of the core members 4*a* and 4*b* are inserted from the top and back surfaces of the substrate 2, such that the core legs 9 of the topside core member 4*a* and the core legs 9 of the backside core member 4*b* abutted each other.

The core-combining member 5 is a member for fitting and combining the pair of core members 4*a* and 4*b* together and is made by bending a metallic plate to have a top plate 12, legs 13, and claws 14. The top plate 12 is a plate covering a top surface 8*a* of the top-plate portion 8 of the core member 4*a*. The legs 13*a* and 13*b* are formed by bending lateral sides of the top plate 12 in an upward direction, and are arranged along the external side surfaces of the core legs 9*a* and 9*c* of the core members 4*a* and 4*b*. The claws 14*a* and 14*b* are formed by inwardly bending end sides of the legs 13*a* and 13*b* so as to abut the top surface 8*a* of the top plate 8 of the core member 4*b*.

The distance h from the top surface 8*a* of the top-plate portion 8 of the core member 4*a* to the top surface 8*a* of the top-plate portion 8 of the core member 4*b* in the state that the core legs 9 of the topside core member 4*a* abut the core legs 9 of the backside core member 4*b* is substantially the same as the spacing between the top plate 12 and the claws 14. Thereby, the core-combining member 5 is fitted to the core members 4*a* and 4*b* in the state abutting each other so as to clamp both the lateral sides of the core members 4*a* and 4*b* in the state abutting each other with the top plate 12 and the claws 14 from both the top and backsides.

By utilizing such a core-combining member 5, the core members 4*a* and 4*b* are combined with each other in a movable state in the front and rear direction (α direction). In addition, the length W in the front and rear direction of each leg-insertion hole 10 is longer than the width w of core legs 9 of the core members 4 so as to allow movement of the core members 4 in the front and rear direction.

The coil device 1 is assembled as follows. For example, first, the core member 4*a* is placed on the top surface of the substrate 2 having the coil pattern section 3 and the leg-insertion holes 10 provided thereon while the core member 4*b* is placed on the back surface. Then, the legs 9 of the topside core member 4*a* are inserted into the respective leg-insertion holes 10 from the topside of the substrate 2. Similarly, the legs 9 of the backside core member 4*b* are inserted into the respective leg insertion holes 10 from the backside of the substrate 2. The core legs 9 of the topside core member 4*a* and the core legs 9 of the backside core member 4*b* are thus abutted to each other.

From the upper side of the core members 4*a* and 4*b*, the left leg 13*a* of the core-combining member 5 is inserted into the left leg-insertion hole 10*a* while the right leg 13*b* of the core-combining member 5 is inserted into the right leg-insertion hole 10*c*, at locations on either side of the core legs 9 of core members 4.

Thus, the top plate 12 of the core-combining member 5 is abutted to the top surface 8*a* of the top-plate portion 8 of the core member 4*a* while the claws 14*a* and 14*b* of the core-combining member 5 are abutted to the top surface 8*a* of the top-plate portion 8 of the core member 4*b*, such that the core members 4*a* and 4*b* that are abutted against each other are provided into the core-combining member 5. Thereby, the core members 4*a* and 4*b* are combined with the core-combining member 5 so as to be attached to the substrate 2. Simultaneously, the core members 4*a* and 4*b* clamp a portion of the coil pattern section 3 therebetween from the top and back sides of the substrate 2.

Thereafter, the combined core members 4*a* and 4*b* are slid with respect to each other in the front and rear direction such that abutting portions of the core members, i.e., abutted end-faces of the core legs 9, are rubbed together. By rubbing the end-faces of the core legs 9 together in such a manner (core rubbing), the following advantages are obtained.

That is, since the core members 4 are made by pressing and sintering magnetic material powder, the end-faces of the core legs 9 of the core members 4 have rough surfaces. During assembling the core members 4*a* and 4*b*, foreign particles often enter between the abutted end-faces of the core legs 9. Therefore, the degree of adhesion between the end-faces, which abut each other, of the core legs 9 is reduced, whereas when the end-faces of the core legs 9 are rubbed against each other, the end-faces of the core legs 9 are polished with each other so as to be close to mirror surfaces. Simultaneously, foreign particles which have entered between the end-faces of the core legs 9 are ground and removed, such that the end faces of the core legs 9 of the topside core member 4*a* are brought into tight contact with the end faces of the core legs 9 of the backside core member 4*b*. By bringing the core members 4*a* and 4*b* into tight contact with each other in such a manner, a reduction in inductance is effectively prevented, and thus, the performance of the coil device 1 is improved.

According to the conventional configuration, since bilateral sides of the pair of core members 4*a* and 4*b* are clamped by pressing them with the core-combining member 5 from both the top and back sides, when the cores are rubbed against each other, the core members 4*a* and 4*b* cannot be slid without a large amount force applied thereto, resulting in reduced efficiency in manufacturing.

Reduced thickness is also demanded for the coil device 1, and when the thickness of the core members 4*a* and 4*b* is reduced to meet the demand, the core members 4*a* and 4*b* are often broken by cracking or chipping, because of the large force that is applied to the core members 4*a* and 4*b* during the core rubbing. Thereby, preventing the thickness of the coil device 1 from being substantially reduced.

SUMMARY OF THE INVENTION

In order to overcome the problems described above, preferred embodiments of the present invention provide a coil device which greatly improves work efficiency during core rubbing in the manufacturing process of the coil device while preventing breaking of core members during the core rubbing when the thickness of the core member is reduced.

According to a preferred embodiment of the present invention, the core-combining member includes the topside cover member and backside cover member, and the pair of core members are clamped and combined by fitting the topside cover member and backside cover member to each other. Thereby, a greatly reduced clamping force must be applied from the core-combining member to the core members as compared with a conventional configuration.

Also, according to preferred embodiments of the present invention, the topside cover member and the backside cover member of the core-combining member are movable back and forth relative to one another in one direction along while the legs are fitted to each other. Therefore, by applying only a small force, the topside and backside core members are moved back and forth relative to one another in one direction while combining the core members together, thereby facilitating core rubbing so as to improve the efficiency of the core rubbing operation.

Since the pair of core members can be relatively moved back and forth in one direction so as to rub cores on each other by applying only a small force, even when the thickness of the core member is reduced, damage to the core member during the core rubbing is prevented. Therefore, the thickness of the core member can be reduced, resulting in a reduction in the thickness of the coil device.

Furthermore, the core-combining member is provided with a stopper, by which the relative movement of the topside cover member and the backside cover member is restricted, such that excessive relative movement of the topside cover member and the backside cover member is prevented.

The stopper has a simple structure including a leg opening and a projection, such that the structure of the core-combining member is not complicated.

According to the present invention, since the core-combining member itself is provided with the stopper, even when a substrate portion extending from a bilateral side-end of the coil pattern section to a substrate side-end is to be a cut-off section, the excessive relative movement of the topside cover member and the backside cover member is prevented. Therefore, by providing the cut-off sections, miniaturization of the substrate is achieved.

Other features, elements, characteristics and advantages of the present invention will become more apparent from the following description of preferred embodiments thereof with reference to the attached drawings.

DETAILED DESCRIPTION OF PREFERRED EMBODIMENTS

Figure 1A:
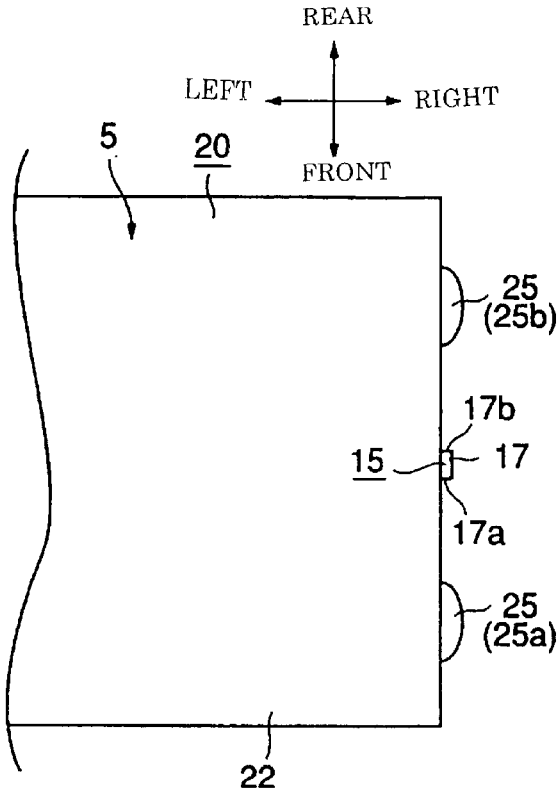
FIGS. 1A to 1C are model drawings showing the structure of a coil device according to a preferred embodiment of the present invention.

A first preferred embodiment of the present invention will be described below with reference to the drawings. In addition, in the description of the first preferred embodiment, like reference characters designate like elements common to the conventional example and description thereof is omitted.

Figure 4:
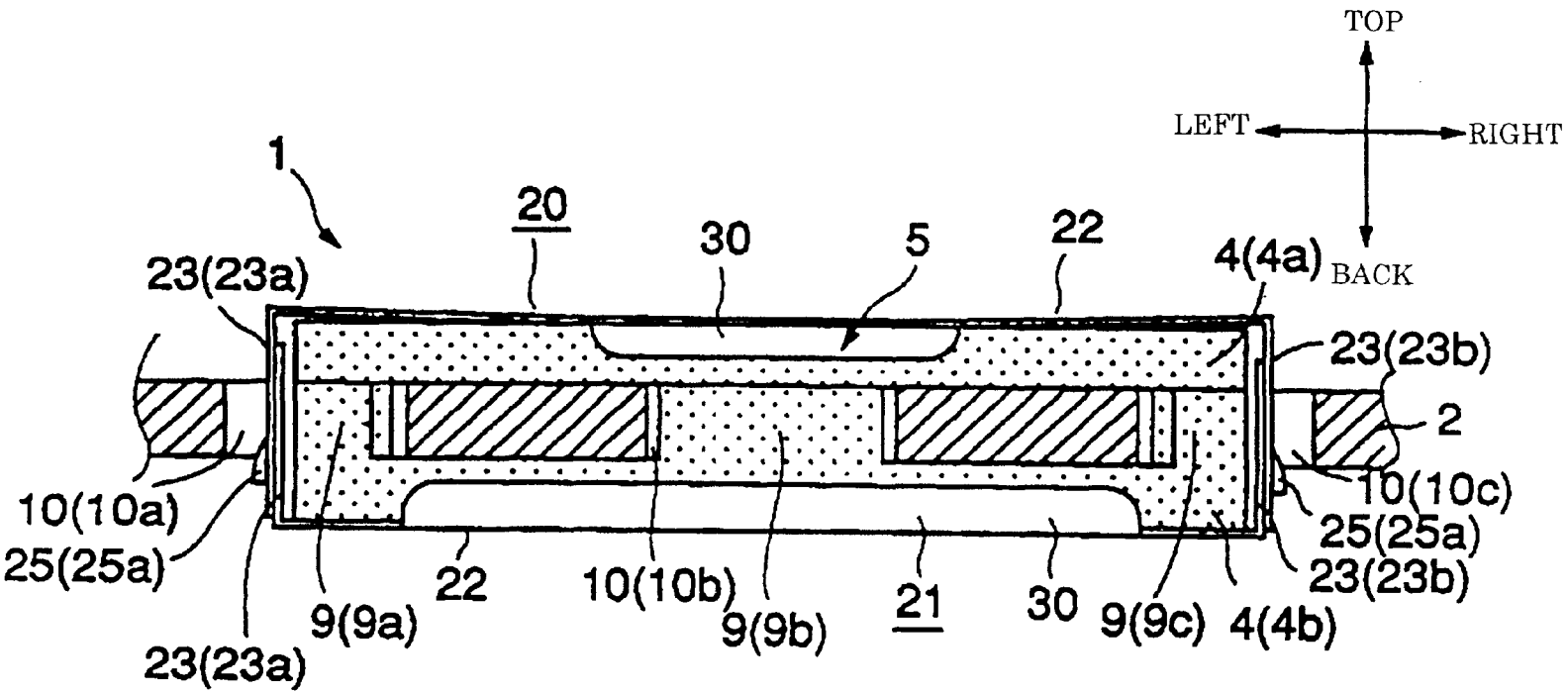
FIG. 4 is a drawing for illustrating a proposed example of a coil device contemplated by the inventor.
Figure 5A:
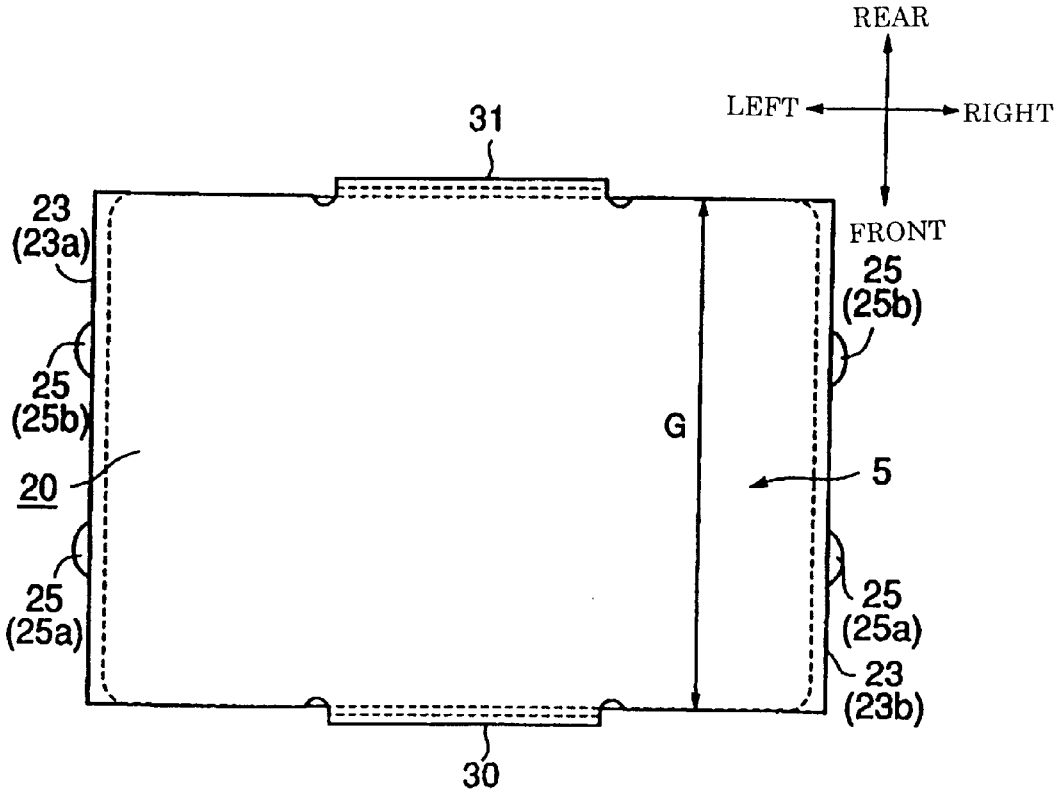
FIGS. 5A and 5B are drawings for showing a core-combining member forming the coil device shown in FIG. 4.
Figure 5B:
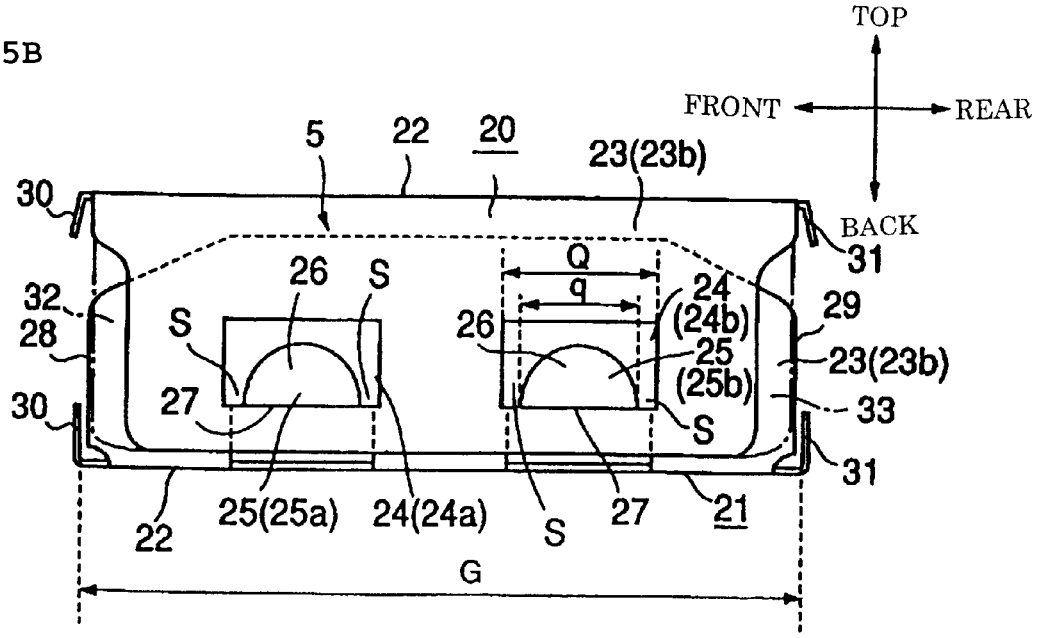
Figure 7A:
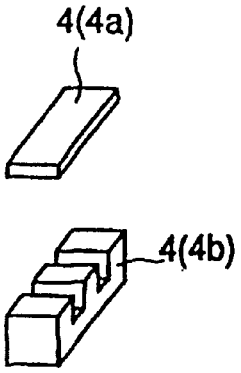
FIGS. 7A to 7C are drawings for illustrating other preferred embodiments.

FIG. 4 illustrates a coil device according to a first preferred embodiment of the present invention. The coil device 1 includes a core-combining member 5. FIG. 5A shows the picked-out core-combining member 5 viewed from the topside. FIG. 5B shows the core-combining member 5 viewed from the right side. In addition, elements other than the core-combining member 5 are substantially the same as those of the conventional example. In the preferred, one core member 4*a* of a pair of core members 4*a* and 4*b* is a core member having an I-shaped cross-section and the other core member 4*b* is a core member having an E-shaped cross-section, as shown in FIG. 7A.

In the first preferred embodiment, the core-combining member 5 is defined by a topside cover member 20 and a backside cover member 21. Both the topside and backside cover members 20 and 21 are made by bending a metallic plate, and each includes a flat base surface 22 and legs 23*a* and 23*b* extending upward from both lateral ends of the base surface 22 to have a substantially U-shape.

The topside and backside cover members 20 and 21 sandwich the pair of core members 4*a* and 4*b* in between the respective base surfaces 22 from the top and back sides of the substrate 2 while the legs 23 are fitted together, so as to clamp the core members 4*a* and 4*b*.

In the first preferred embodiment, the front end of each of the base surfaces 22 of the topside and backside cover members 20 and 21 is provided with a front projection claw 30 which extend in the upward and downward directions of the substrate 2. Also, the rear end of each of the base surfaces 22 of the topside and backside cover members 20 and 21 is provided with a rear projection claw 31 which protrudes in the upward and downward directions.

In the first preferred embodiment, the width G of each of the base surfaces 22 of the topside and backside cover members 20 and 21 in the front and rear direction is substantially the same as the width w of the core members in the front and rear direction. Accordingly, when the legs 23 of the topside and backside cover members 20 and 21 are fitted together such that the core members 4*a* and 4*b* are clamped with the base surfaces 22 of the topside and backside cover members 20 and 21, the front projection claws 30 of the topside and backside cover members 20 and 21 are retained to the front end surfaces of the core members 4*a* and 4*b*, respectively, while the rear projection claws 31 of the topside and backside cover members 20 and 21 are retained to the rear end surfaces of the core members 4*a* and 4*b*, respectively. The locations of the core members 4*a* and 4*b* in the front and rear direction are thereby restricted.

In the first preferred embodiment, the topside and backside cover members 20 and 21 include right and left legs 23 of the topside cover member 20, which are located outwardly of the right and left legs 23 of the backside cover member 21 in the fitted state. The right and left legs 23 of the top side cover member 20 are provided with leg openings 24*a* and 24*b*, respectively (see FIG. 5B), and the right and left legs 23 of the backside cover member 21 are provided with convex portions 25*a* and 25*b* which extend outwardly through the leg openings 24*a* and 24*b* of the outside legs 23. Each of the convex portions 25*a* and 25*b* includes a spherical curved surface (inclined surface) 26 and a flat retaining surface 27 for being retained by the edge of the leg opening 24.

When the legs 23 of the topside cover member 20 and the legs 23 of the backside cover member 21 are fitted to each other and the retaining surfaces 27 of the convex portions 25 are retained by edges of the leg openings 24, the topside cover member 20 and the backside cover member 21 are prevented from detaching from one another. At this time, the arrangement of the leg openings 24 and the convex portions 25 is designed such that the core members 4*a* and 4*b* are clamped in a state of abutment by the topside and backside cover members 20 and 21.

In the first preferred embodiment, the width Q of the leg opening 24 in the front and rear direction is greater than the width q of the convex portion 25 in the front and rear direction, such that a clearance S is provided between the convex portion 25 and the front edge or rear edge of the leg opening 24. Due to the clearance S, the topside and backside cover members 20 and 21 are relatively movable in the front and rear direction in the state in which the core members 4*a* and 4*b* are clamped therebetween.

In the first preferred embodiment, via the front and rear projection claws 30 and 31, the locations of the topside and backside core members 4*a* and 4*b* are restricted in the front and rear direction relative to the topside and backside cover members 20 and 21, respectively. Moreover, the topside and backside cover members 20 and 21 are relatively movable in the front and rear direction when the topside and backside cover members 20 and 21 are attached together. Therefore, when the topside and backside cover members 20 and 21 clamp the core members 4*a* and 4*b* therebetween, by relatively moving the topside and backside cover members 20 and 21 in the front and rear direction, the core members 4*a* and 4*b* are relatively moved in the front and rear direction integrally with the cover members 20 and 21 so as to rub the cores.

In the first preferred embodiment, when rubbing the cores to each other, the backside cover member 21 is fixed and the topside cover member 20 is moved in the front and rear direction so as to rub the core members 4*a* and 4*b* against each other without moving both the topside and backside cover members 20 and 21 in the front and rear direction.

That is, in the first preferred embodiment, the width W of the core-leg insertion hole 10 in the front and rear direction is substantially the same as the width G of the leg 23 of the backside cover member 21 in the front and rear direction. Accordingly, when the legs 23 of the backside cover member 21 are inserted into the core-leg insertion holes 10, front end-faces 28 and rear end-faces 29 of the legs 23 of the backside cover member 21 are retained by respective internal walls of the core-leg insertion holes 10, so as to prevent the backside cover member 21 from moving in the front and rear direction.

The leg 23 of the topside cover member 20 is provided with cut-off portions 32 and 33, which abut internal walls of the core-leg insertion holes 10 when moving the topside cover member 20 in the front and rear direction. Due to the cut-off portions 32 and 33, the topside cover member 20 is movable even when the legs 23 are inserted into the core-leg insertion holes 10.

Figure 6A:
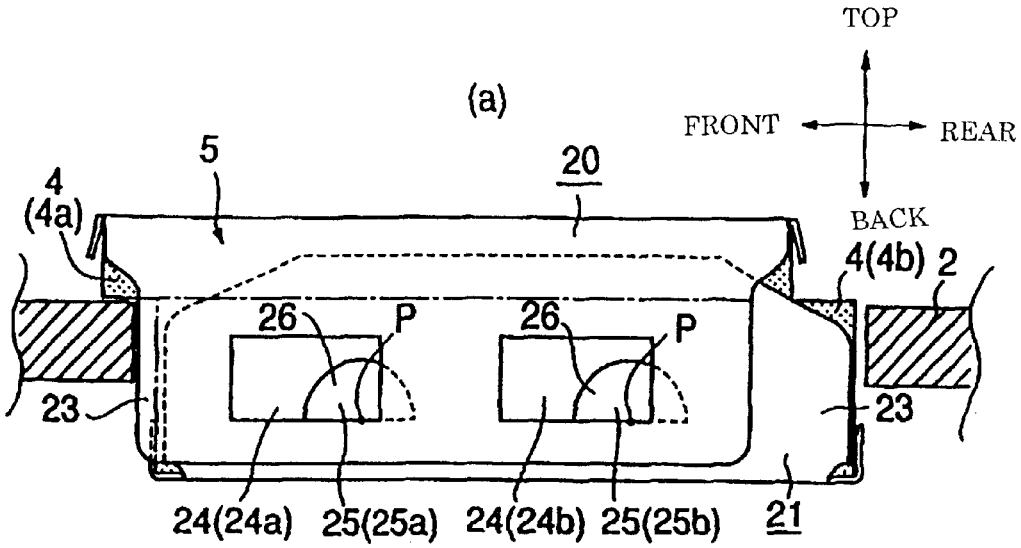
FIGS. 6A to 6C are drawings for illustrating the function of the core-combining member shown in FIGS. 5A and 5B.
Figure 6B:
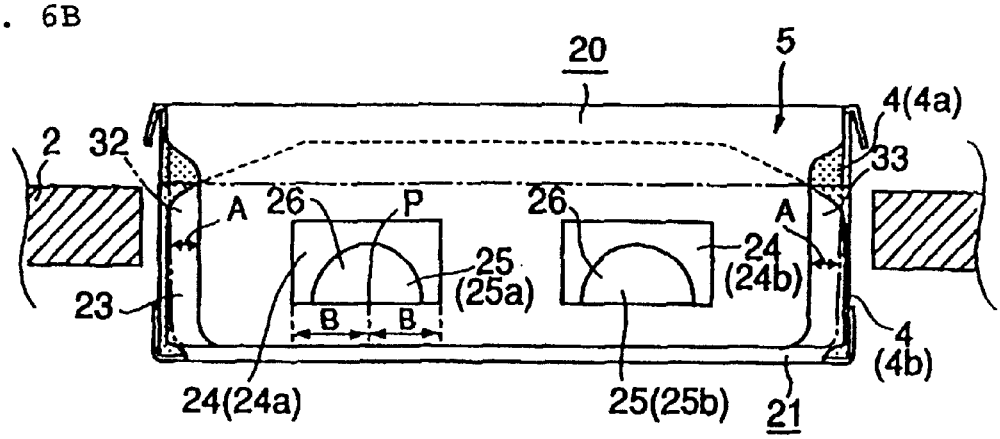
Figure 6C:
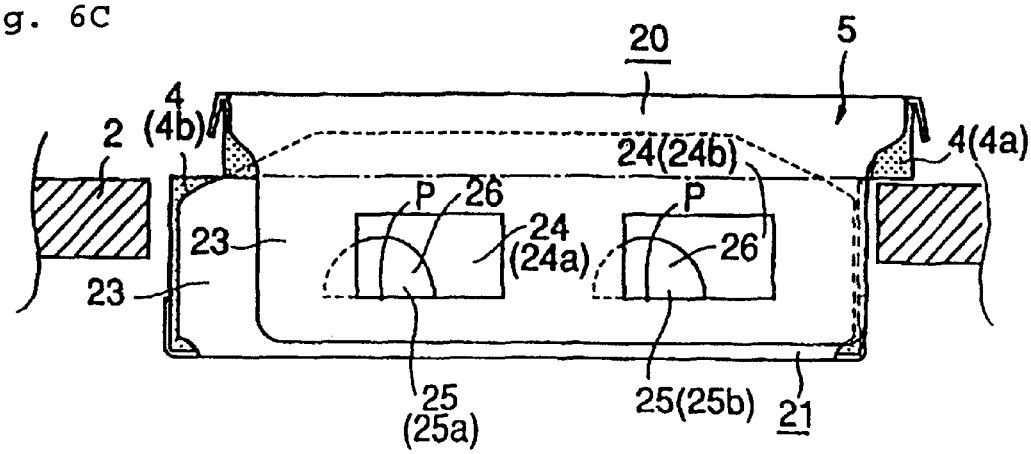

In the first preferred embodiment, since the convex portion 25 includes the spherical curved surface (inclined surface) 26, when the topside cover member 20 is moved in the front and rear direction relative to the backside cover member 21, as shown in FIGS. 6A and 6C, the front edge or rear edge of the leg opening 24 is movable by extending over the curved surface 26 of the convex portion 25. Thereby, the displacement of the topside cover member 20 in the front and rear direction is greater than the clearance S between the convex portion 25 and the edge of the leg opening 24.

In addition, in the first preferred embodiment, the central portion of the base surface 22 of the topside cover member 20 extends slightly below both lateral ends (see FIG. 4). Therefore, a pressing force can be applied to the core member 4*a* from the central portion of the base surface 22. Since the core members 4*a* and 4*b* are made by sintering magnetic material powder, the dimensional accuracy of the product is not optimal. With the configuration of the first preferred embodiment, in which a pressing force is applied to the core member 4*a* from the central portion of the base surface 22, the core members 4*a* and 4*b* having dimensional inaccuracies are securely clamped with the topside and backside cover members 20 and 21.

An assemble process of the coil device 1 utilizing such a core-combining member 5 will now be described. For example, first, the core members 4*a* and 4*b* are arranged on both the top and back surfaces of the substrate 2, respectively, in the same manner as in the conventional example. Then, the I-shaped core member 4*a* is placed on the substrate 2 so as to extend into the core-leg insertion holes 10*a*, 10*b*, and 10*c*. Also, the core legs 9 of the E-shaped core member 4*b* are inserted into the respective core-leg insertion holes 10 such that the topside and backside core members 4*a* and 4*b* are abutted on each other.

Next, the topside and backside cover members 20 and 21 are arranged on the topside and backside core members 4*a* and 4*b*, respectively. Then, the legs 23 of the topside and backside cover members 20 and 21 are inserted into the respective core-leg insertion holes 10 so as to cover the core members 4*a* and 4*b* with the topside and backside cover members 20 and 21, such that the legs 23 of the topside and backside cover members 20 and 21 are fitted into each other.

At this time, the retaining surface 27 of the convex portion 25 in the backside cover member 21 is retained by the edge of the leg opening 24 to prevent detachment, such that the abutment between the legs 23 of the topside and backside cover members 20 and 21.

The core members 4*a* and 4*b* are thereby clamped and combined together with the topside and backside cover members 20 and 21. Simultaneously, the core members 4*a* and 4*b* sandwich a portion of the coil pattern section 3 provided on the substrate 2 therebetween.

Thereafter, the topside cover member 20 is moved in the front and rear direction relative to the backside cover member 21 while the topside and backside cover members 20 and 21 clamp the core members 4*a* and 4*b* therebetween. Integrally with the topside cover member 20, the topside core member 4*a* is moved to slide in the front and rear direction relative to the backside core member 4*b* fixed to the backside cover member 21, such that abutting portions of the core members 4*a* and 4*b* are rubbed against each other. By the core rubbing, the abutting portions of the core members 4*a* and 4*b* are polished by each other to have mirror surfaces, and also, foreign particles existing between the abutting portions are ground and removed. Thereby, the abutting portions between the core members 4*a* and 4*b* are brought into close contact with each other.

By using the core-combining member 5 shown in the first preferred embodiment, a clamping force applied to the core members 4*a* and 4*b* by the core-combining member 5 is greatly reduced. Since a large force is not applied to the core members 4*a* and 4*b* during the core rubbing, rubbing of the core members 4*a* and 4*b* is more easily performed, thereby improving the efficiency of the core rubbing work.

Moreover, since a large force is not applied to the core members 4*a* and 4*b* during the core rubbing, even when the core members 4*a* and 4*b* have a reduced thickness, the core members 4*a* and 4*b* are not broken due to the large force applied thereto during the core rubbing, such that the thickness of the core members 4*a* and 4*b* can be further reduced.

In a conventional configuration, the width W of the core-leg insertion hole 10 in the front and rear direction is substantially greater than the width w of core legs 9 in the front and rear direction. Therefore, shifts in the positions of the core members 4*a* and 4*b* relative to the coil pattern section 3 in the front and rear direction and shifts in the positions between core members 4*a* and 4*b* in the front and rear direction often occur. When such shifts in the positions of the core members 4*a* and 4*b* occur, the inductance is substantially reduced, which deteriorates performance of the coil device 1.

Whereas, in the first preferred embodiment of the present invention, with the front and rear projection claws 30 and 31, the positional arrangement of the core members 4*a* and 4*b* relative to the topside and backside cover members 20 and 21 in the front and rear direction is accurately maintained. Also, by reducing the clearance S between the convex portion 25 and the leg opening 24 in the front and rear direction, shifts in the locations between core members 4*a* and 4*b* in the front and rear direction are prevented. Moreover, according to the first preferred embodiment, the width W of the core-leg insertion hole 10 in the front and rear direction is substantially the same as the width G of the leg 23 of the backside cover member 21 in the front and rear direction, such that the backside cover member 21 is fixed to the core-leg insertion holes 10, thereby eliminating shifts in the locations of the core members 4*a* and 4*b* relative to the coil pattern section 3.

Moreover, in the first preferred embodiment of the present invention, the convex portion 25 includes a spherical curved surface 26 provided thereon, such that the edge of the leg opening 24 can extend over the curved surface 26 of the convex portion 25 during movement of the topside cover member 20 in the front and rear direction. Therefore, even when the clearance S between the convex portion 25 and the edge of the leg opening 24 in the front and rear direction is reduced, the displacement of the topside cover member 20 in the front and rear direction is increased, which provides improved core-rubbing.

According to the first preferred embodiment of the present invention, the abutting portions between the core members 4*a* and 4*b* are preferably brought into close contact with each other, and also the core members 4*a* and 4*b* are positioned according to the setting, such that the performance of the coil device 1 is not deteriorated, resulting in a coil device 1 having highly reliable performance.

However, it is understood that the coil device 1 according to the first preferred embodiment may have the following problem. That is, the fitting relationship between the topside and backside cover members 20 and 21 may be cancelled during core rubbing. The reason for this is that according to the preferred embodiment, the core-combining member 5 itself is not provided with a mechanism to restrict the relative movement of the topside and backside cover members 20 and 21 in the front and rear direction, such that for example, the front end-face or rear end-face of the leg 23 of the topside cover member 20 is retained to an internal wall of the core-leg insertion hole 10 of the substrate 2 so as to prevent the movement of the topside cover member 20 in the front and rear direction.

Because of such a configuration, the length of the core-leg insertion hole 10 in the front and rear direction and the length of the leg 23 of the topside cover member 20 in the front and rear direction have to be designed such that when moving the topside cover member 20 relative to the backside cover member 21, the front end-face or rear end-face of the leg 23 of the topside cover member 20 is retained by an internal wall of the core-leg insertion hole 10 so as to prevent the movement of the topside cover member 20 in the front and rear direction before the edge of the leg opening 24 extends over the apex P of the convex portion 25.

However, dimensional accuracy may not be obtained due to processing inaccuracies. Therefore, the length of the core-leg insertion hole 10 in the front and rear direction may be too long relative to the length of the leg 23 of the topside cover member 20 in the front and rear direction, such that during the core-rubbing, before the front end-face or rear end-face of the leg 23 of the topside cover member 20 is retained by an internal wall of the core-leg insertion hole 10, the edge of the leg opening 24 may extend over the apex P of the convex portion 25. At this time, the convex portion 25 may detach from the leg opening 24.

A coil device according to a second preferred embodiment of the present invention will be described below.

Figure 1B:
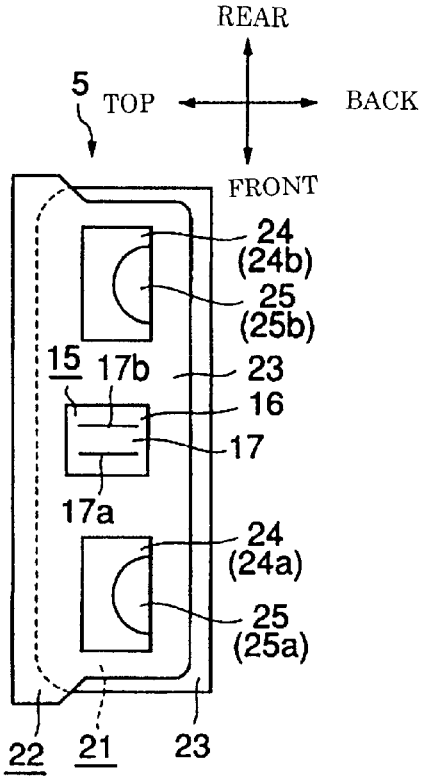
Figure 1C:
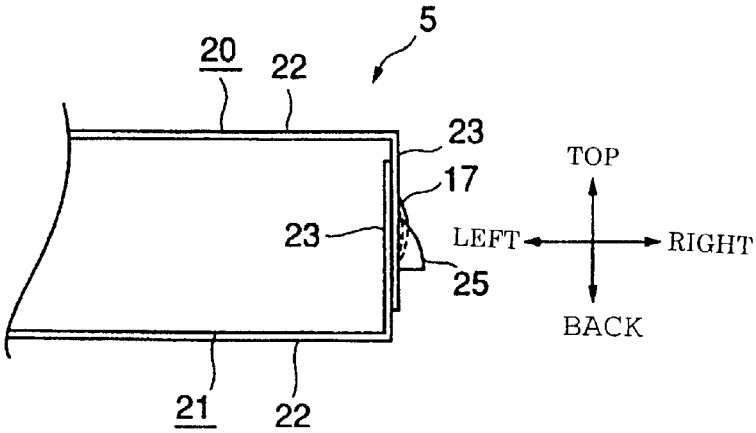

FIG. 1A shows a portion of a core-combining member included in the coil device according to the preferred embodiment and viewed from the topside. FIG. 1B shows the core-combining member shown in FIG. 1A viewed from the right side. FIG. 1C shows the core-combining member shown in FIG. 1A viewed from the front side.

According to the second preferred embodiment, the core-combining member 5 is provided with stopper means 15 to restrict the displacement of the topside cover member 20 relative to the backside cover member 21 in the front and rear direction. Configurations other than the core-combining member 5 are substantially the same as those of the coil device 1 according to the first preferred embodiment, like reference characters designate like elements common to the coil device 1 according to the first preferred embodiment and description thereof is omitted.

According to the second preferred embodiment, the stopper member 15 includes stopper openings 16 and projection portions 17. The stopper openings 16 are provided in the legs 23, which are located outside of the legs 23 of the topside cover member 20 when the legs 23 of the topside cover member 20 are fitted with the legs 23 of the backside cover member 21 (i.e., the legs 23 of the topside cover member 20 according to the second preferred embodiment). The location of the stopper opening 16 is not specifically limited. As an example, the stopper opening 16 is provided between the opening 24*a* and the opening 24*b* according to the second preferred embodiment.

The projection portions 17 are provided in the legs 23, which are located inside when the legs 23 of the topside and backside cover members 20 and 21 are in the fitted together (i.e., the legs 23 of the backside cover member 21 according to the second preferred embodiment). The projection portion 17 is located in the leg 23 at a position such that the projection portion 17 extend outward from the stopper opening 16 when the legs 23 of the topside and backside cover members 20 and 21 are fitted with each other. In addition, according to the second preferred embodiment, the stopper member 15 (the stopper openings 16 and the projection portions 17) are provided in opposing legs 23 of the topside and backside cover members 20 and 21, however, in FIGS. 1A to 1C, the left side stopper member is not shown.

Figure 2:
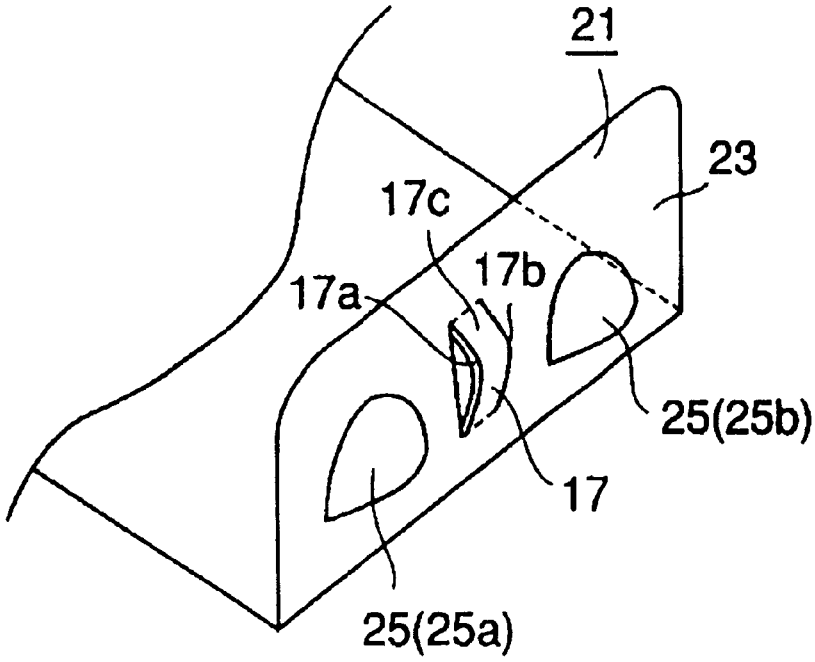
FIG. 2 is a model drawing schematically showing a portion of a backside cover member forming a core-combining member shown in FIGS. 1A to 1C.

FIG. 2 shows the leg 23 of the backside cover member 21 in a schematic perspective view. As shown in FIG. 2, the projection portion 17 is formed by cutting, such that cut-edges 17*a* and 17*b* formed on both front and rear sides of the projection portion 17 are retained by edges of the stopper opening 16. The cut-edge 17*a* or cut-edge 17*b* of the projection portion 17 is retained by an edge of the stopper opening 16, such that the movement of the topside cover member 20 in the front and rear direction relative to the backside cover member 21 is prevented.

Figure 3:
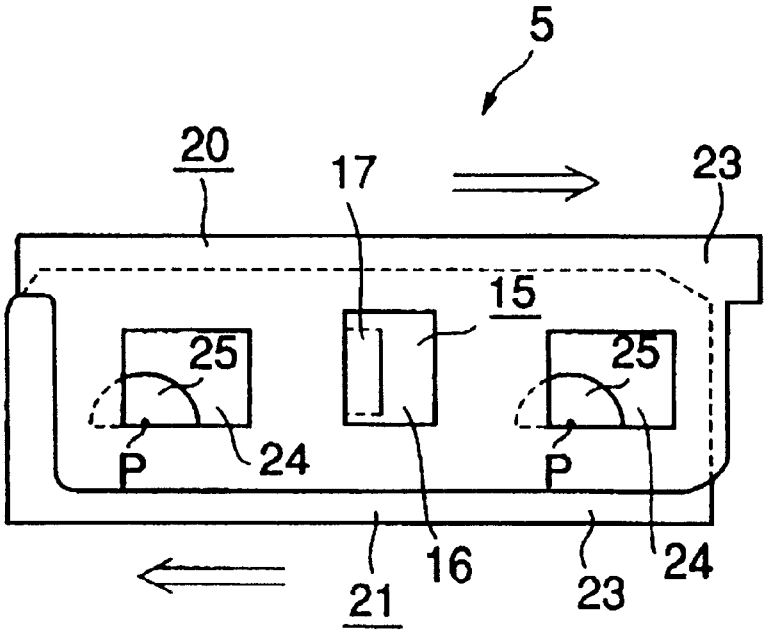
FIG. 3 is a drawing for illustrating a stopper means provided in the core-combining member shown in FIGS. 1A to 1C.

According to the second preferred embodiment, when the topside cover member 20 is moved in the front and rear direction relative to the backside cover member 21, as shown in FIG. 3, the stopper opening 16 and the projection portion 17 are arranged such that before the edge of the leg-opening 24 extends over the apex P of the convex portion 25, the edge of the stopper opening 16 is retained by the projection portion 17.

The projection portion 17 is conical when viewed in the front and rear direction. Due to an inclined surface 17*c* of the cone-shape, the edge of the leg 23 of the topside cover member 20 is prevented from getting snagged on the projection portion 17 when the legs 23 of the topside cover member 20 are fitted to the legs 23 of the backside cover member 21.

According to the second preferred embodiment, since the configuration is substantially the same as that of the first preferred embodiment, advantages are obtained in the same manner as in the first preferred embodiment. Because the stopper member 15 is further provided therein, when the topside cover member 20 is moved relative to the backside cover member 21 in the front and rear direction, before the edge of the leg-opening 24 extends over the apex P of the convex portion 25, the relative movement of the topside cover member 20 in the front and rear direction is prevented by the stopper means 15. Therefore, the problem in which the edge of the leg-opening 24 extends over the apex P of the convex portion 25 is effectively prevented.

In addition, the present invention is not limited to the preferred embodiments, and various modifications may be applied thereto. For example, according to the second preferred embodiment, each of the opposing legs 23 of the topside cover member 20 include two leg openings 24, however, the number of the legs 23 is not limited, such that one, three or more legs may be provided. Similarly, the number of the convex portions 25 provided in the opposing legs 23 of the backside cover member 21 also is not limited. However, by arranging a plurality of leg openings 24 and convex portions 25 in each leg 23, the stability of the fitting state between the legs 23 is further increased.

According to the preferred embodiments, the convex portion 25 is provided with the spherical curved surface 26 formed therein, which is the inclined surface, over which the edge of the leg-opening 24 extends when the topside cover member 20 is moved in the front and rear direction. However, the shape of the inclined surface is not limited to be the spherical curved surface, and for instance, the convex portion 25 may have a triangular pyramidal shape and the inclined surface may be define by the triangular inclined plane thereof.

Moreover, according to the preferred embodiments, when the topside and backside cover members 20 and 21 are fitted together, the legs 23 of the topside cover member 20 are located outside the legs 23 of the backside cover member 21. Conversely, the legs 23 may be fitted together such that the legs 23 of the backside cover member 21 are located outside the legs 23 of the topside cover member 20. In this case, the leg 23 of the backside cover member 21, which is located outside, is provided with the leg opening 24 formed therein while the leg 23 of the topside cover member 20, which is located inside, is provided with the convex portion 25 formed therein.

Moreover, according to the preferred embodiments, while fixing the backside cover member 21, the topside cover member 20 is moved relative to the backside cover member 21 in the front and rear direction. Conversely, while fixing the topside cover member 20, the backside cover member 21 may be moved relative to the topside cover member 20 in the front and rear direction. In such a configuration, the moving leg 23 of the backside cover member 21 is provided with the cut-off portions 32 and 33. Also, the E-shaped core member is arranged on the fixing topside while the I-shaped core member is arranged on the moving backside.

Moreover, according to the preferred embodiments, the topside cover member 20 is provided with the cut-off portions 32 and 33 formed therein. However, when the width W of the core-leg insertion hole 10 in the front and rear direction is greater than the width G of the leg 23 of the topside cover member 20 and the backside cover member 21 in the front and rear direction, for example, the cut-off portions 32 and 33 may be omitted. In this case, since the backside cover member 21 is not fixed by the core-leg insertion holes 10, another device for fixing the backside cover member 21 may be employed during core rubbing. Alternatively, during core rubbing, both the topside and backside cover members 20 and 21 may be moved in the front and rear direction.

Figure 7B:
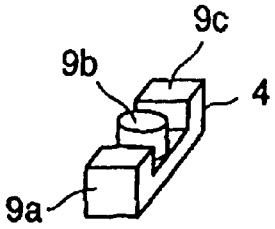
Figure 7C:
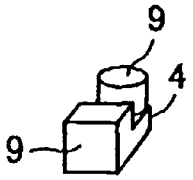

Moreover, according to the preferred embodiments, the backside core member 4*b* is an E-shaped core member. However, as shown in FIG. 7B, it may be an EER-type core member 4, in which the central core leg 9*b* is cylindrical. Furthermore, as shown in FIG. 7C, a UR-type core member 4 may be used, which has a U-shaped section with two core legs 9, one core leg 9 being square pole-shaped, the other core leg 9 being cylindrical. When the UR-type core member 4 is mounted on the coil pattern section 3, one core leg 9 of the two core legs 9 is arranged at the center of the coil pattern section 3 formed on the substrate 2 while the other core leg 9 is arranged outside the coil pattern section 3.

Figure 8:
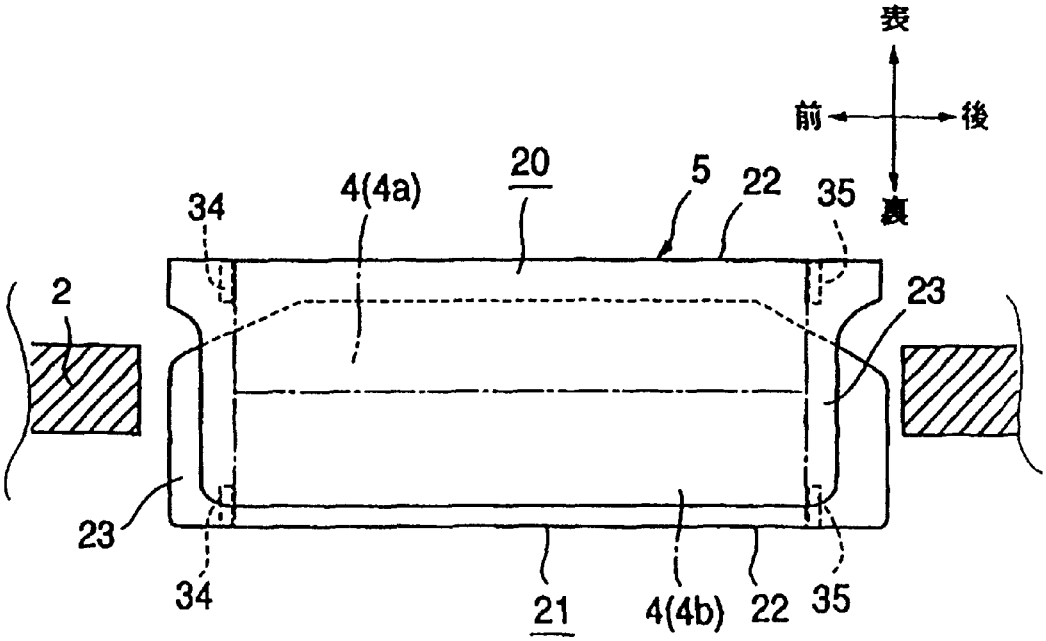
FIG. 8 is a drawing for illustrating still another preferred embodiment.

Moreover, according to the preferred embodiments, one of the pair of core members 4 is an I-shaped core member while the other is an E-shaped core member. However, both of the core legs may be E-shaped, EER-type, or UR-type core members. In this case, for example, as shown in FIG. 8, the topside and backside cover members 20 and 21 are configured to overhang from the core members 4 in the front and rear directions, and on the internal surface of each base surface 22 of the topside and backside cover members 20 and 21, convex portions 34 and 35 are provided to restrict the positional arrangement of the core members 4 in the front and rear direction.

Moreover, according to the second preferred embodiment, one of the stopper members 15 (the stopper openings 16 and the projection portions 17) is provided in each of opposing legs 23 of the topside and backside cover members 20 and 21; however, a plurality of members may be provided in each of the opposing legs 23. Also, the stopper member 15 may be provided in one of opposing legs 23 of the topside and backside cover members 20 and 21.

Moreover, according to the second preferred embodiment, the projection portion 17 is cone-shaped when viewed in the front and rear direction. However, the projection portion 17 is not limited to the cone-shape.

Moreover, according to the preferred embodiments, the core-leg insertion hole 10*b* is provided in the substrate portion at the center of the coil pattern section 3 (coil pattern 7) while the core-leg insertion holes 10*a* and 10*c* are also provided in a substrate portion on both sides of the coil pattern section 3. According to the first preferred embodiment, when the topside cover member 20 is moved in the front and rear direction relative to the backside cover member 21, the front end-faces or rear end-faces of the legs 23 of the topside cover member 20 are retained by internal walls of the core-leg insertion holes 10*a* and 10*c* so as to prevent the relative movement of the topside cover member 20 in the front and rear direction. Thereby, deviation in the fitting state between the topside and backside cover members 20 and 21 is prevented. Therefore, the core-leg insertion holes 10 outside the coil pattern section 3, i.e., the core-leg insertion holes 10*a* and 10*c* to be inserted with the legs 23 of the topside cover member 20, are essential for the first preferred embodiment.

Figure 9A:
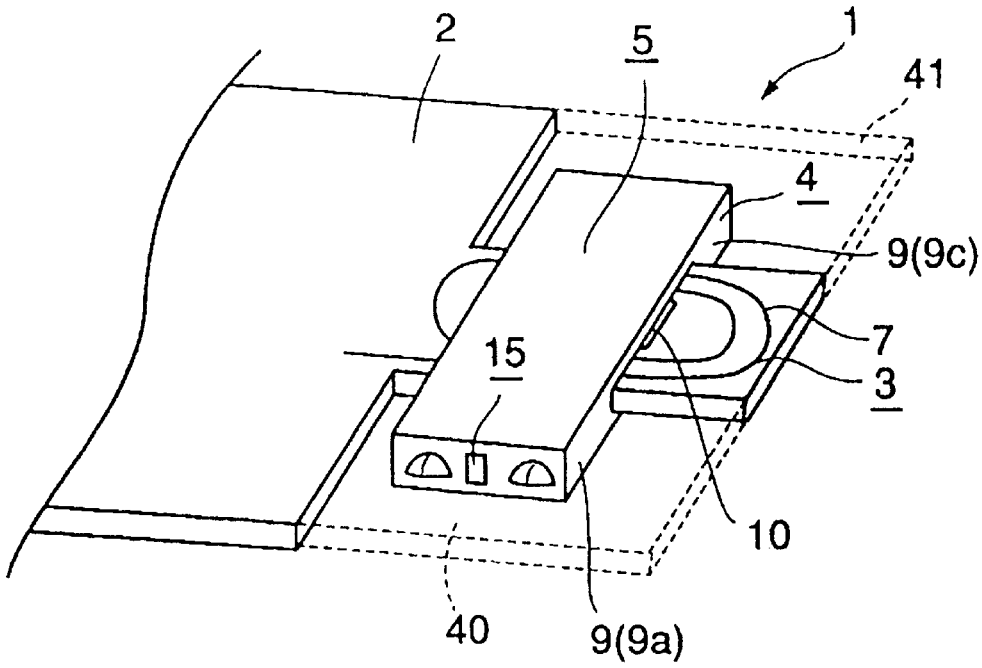
FIGS. 9A and 9B are drawings for illustrating still another preferred embodiment.

Whereas, according to the second preferred embodiment, because the core-combining member 5 itself is provided with the stopper member 15 formed therein, the relative movement of the topside and backside cover members 20 and 21 in the front and rear direction is prevented without the core-leg insertion holes 10*a* and 10*c*. Therefore, by providing the stopper member 15, the coil device 1 may be configured as shown in FIG. 9A.

Figure 9B:
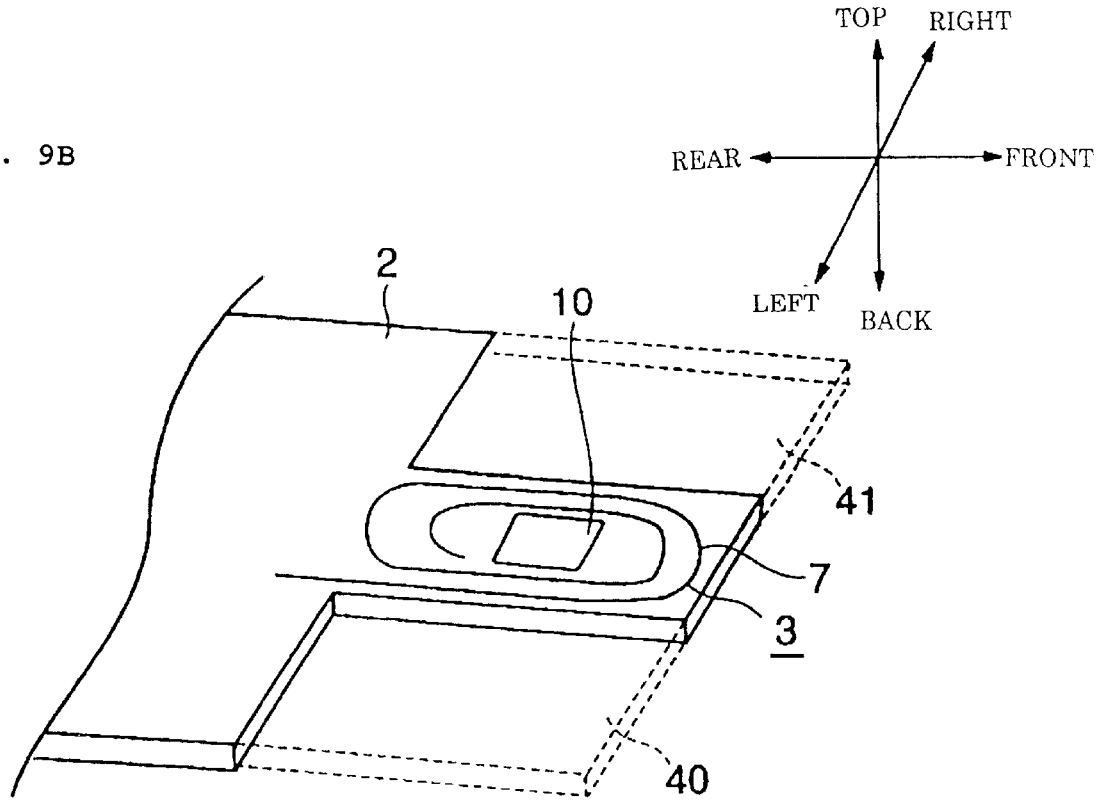
Figure 10A:
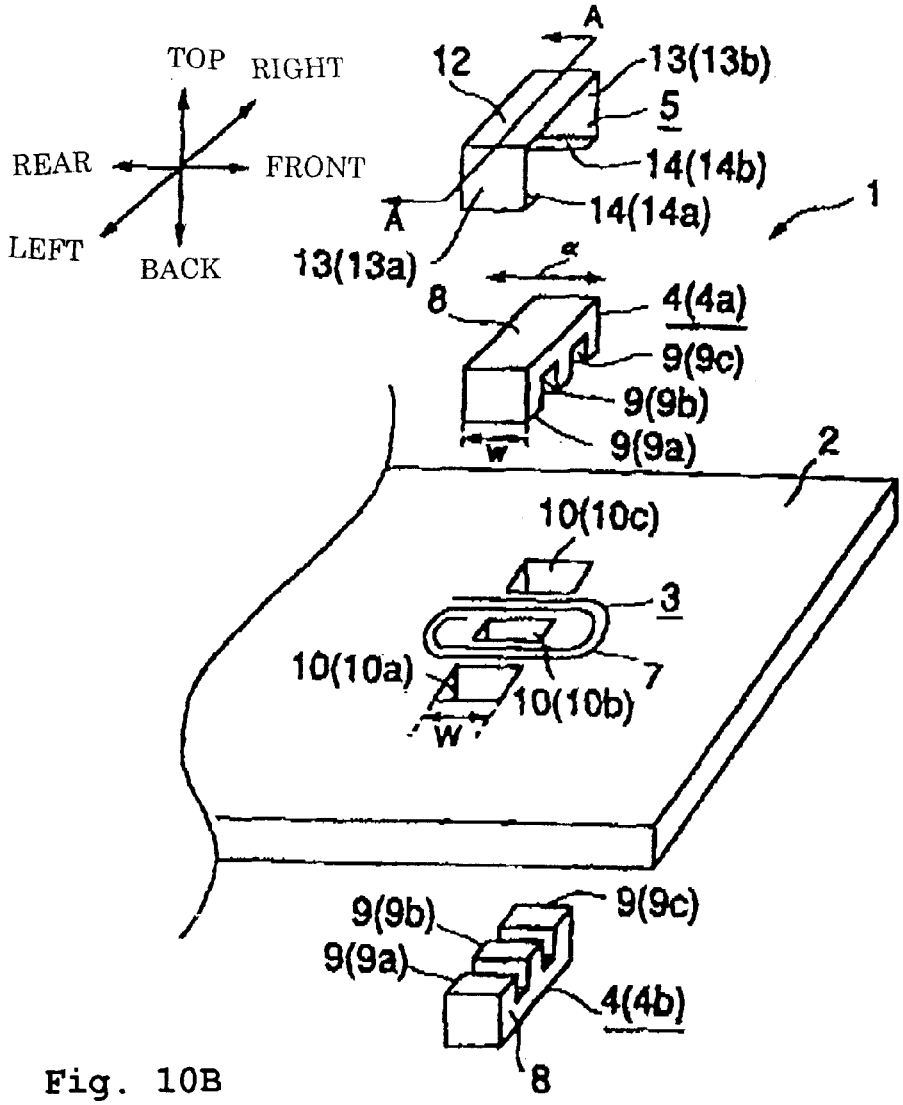
Fig. 10A PRIOR ART
FIGS. 10A and 10B are drawings for illustrating a conventional coil device.
Figure 10B:
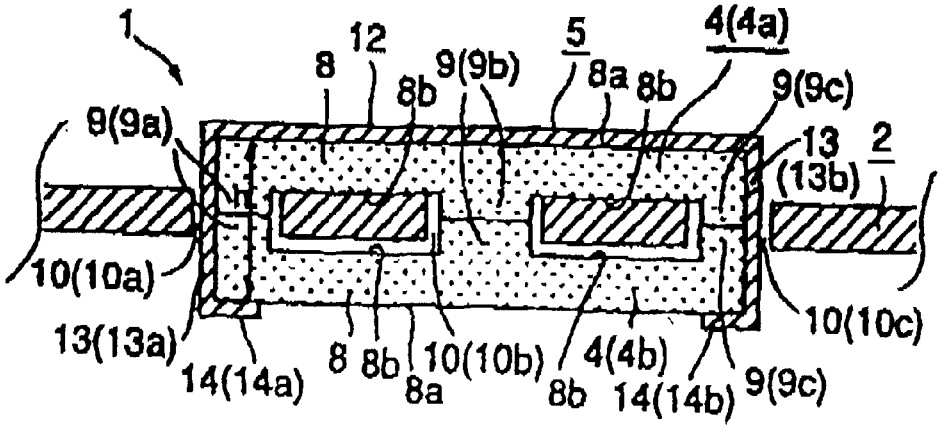
Fig. 10B PRIOR ART

In the configuration, as shown in FIG. 9B, the coil pattern section 3 (coil pattern 7) is provided in a side-edge region of the substrate 2. In a substrate portion at the central portion of the coil pattern section 3, the core-leg insertion hole 10 is provided. Also, substrate portions ranging from opposing side-ends of the coil pattern section 3 to substrate side-ends are cut-off sections 40 and 41. In the cut-off sections 40 and 41, the core legs 9*a* and 9*c* of the core member 4 are arranged. Into the core-leg insertion hole 10, the core leg 9*b* of the core member 4 is inserted.

In addition, the arrangement includes a case having a core member with three core legs 9 (E-shaped core member, for example), in which the cut-off sections 40 and 41 are provided corresponding to the bilateral core legs 9*a* and 9*c* of the core member 4. However, when using a core member having two core legs 9 (UR-type core member, for example), one of the substrate portions on opposing sides of the coil pattern section 3 may be cut off.

By forming the cut-off section in such a manner, the size of the substrate 2 is greatly reduced.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A coil device comprising:

a substrate having a coil pattern provided thereon and a core-leg-insertion hole provided in a coil-pattern-forming region of the substrate;

a pair of core members to sandwich a portion of the coil pattern; and a core-combining member to combine the pair of core members by clamping the pair of core members utilizing the core-leg-insertion hole, the core-combining member comprising:

a substantially U-shaped topside cover member; and a substantially U-shaped backside cover member;

each of the topside cover member and the backside cover member comprising a base surface and legs extending from both lateral ends of the base surface;

wherein the pair of core members are sandwiched between base surfaces of the topside cover member and the backside cover member while the legs are fitted together such that the pair of core members are combined together; and wherein the topside cover member and the backside cover member are relatively movable back and forth in one direction while the legs are fitted together, and the core-combining member is provided with a stopper member to restrict the relative displacement of the topside cover member and the backside cover member back and forth in one direction.

2. A device according to claim 1, wherein the stopper member includes an opening provided in an externally located leg in a fitted state among the legs of the topside cover member and the backside cover member, and a projection provided in an internally located leg for retaining an edge of the opening of the leg to be fitted.

3. A device according to claim 1, further comprising a substrate portion extending from a lateral side-end of the coil pattern-forming region to a substrate side-end is a cut-off section; wherein a core-leg-insertion hole is provided in a substrate portion at the approximate center of the coil patterns and the core legs of the core member are inserted into and arranged in the cut-off section and the core-leg-insertion hole, respectively.

4. A device according to claim 2, further comprising a substrate portion extending from a lateral side-end of the coil pattern-forming region to a substrate side-end is a cut-off section; wherein a core-leg-insertion hole is provided in a substrate portion at the approximate center of the coil pattern, and the core legs of the core member are inserted into and arranged in the cut-off section and the core-leg-insertion hole, respectively.

5. A device according to claim 1, wherein one of said pair of core members is I-shaped, and the other of said pair of core members is E-shaped.

6. A device according to claim 1, wherein the legs of the backside cover member are provided with convex portions, and the legs of the topside cover member are provided with leg openings to receive the convex portions of the backside cover member.

7. A device according to claim 6, wherein the convex portions includes a spherical curved surface and a flat retaining surface to be retained by an edge of the leg openings.

8. A device according to claim 2, wherein the projection is conical and includes inclined surfaces.

9. A device according to claim 1, wherein the backside core member is an EER-type core member including a cylindrical central core leg.

10. A device according to claim 1, wherein the backside core member is a UR-type core member including a such shaped section with two core legs, one of the core legs having a square pole-shaped and the other of the core legs having a cylindrical shape.

11. A coil device comprising:

a substrate having a coil pattern and a core-leg-insertion holes provided thereon;

a pair of core members surrounding a portion of the coil pattern on the top and back side thereof; and a core-combining member arranged to clamp the pair of core members utilizing the core-leg-insertion hole, the core-combining member comprising:

a substantially U-shaped topside cover member; and a substantially U-shaped backside cover member;

each of the topside cover member and the backside cover member including a base surface and legs extending from lateral ends of the base surface;

wherein the pair of core members are arranged between the base surfaces of the topside cover member and the backside cover member and the legs are attached together such that the pair of core members are clamped together; and wherein the topside cover member and the backside cover member are movable relative to each other back and forth when the legs are attached together, and the core-combining member includes a stopper member to restrict movement of the topside cover member with respect to the backside cover member.

12. A device according to claim 11, wherein the stopper member includes an opening provided in an externally located leg in a fitted state among the legs of the topside cover member and the backside cover member, and a projection provided in an internally located leg for retaining an edge of the opening of the leg to be fitted.

13. A device according to claim 11, further comprising a substrate portion extending from a lateral side-end of the coil pattern-forming region to a substrate side-end is a cut-off section; wherein a core-leg-insertion hole is provided in a substrate portion at the approximate center of the coil pattern, and the core legs of the core member are inserted into and arranged in the cut-off section and the core-leg-insertion hole, respectively.

14. A device according to claim 12, further comprising a substrate portion extending from a lateral side-end of the coil pattern-forming region to a substrate side-end is a cut-off section; wherein a core-leg-insertion hole is provided in a substrate portion at the approximate center of the coil pattern, and the core legs of the core member are inserted into and arranged in the cut-off section and the core-leg-insertion hole, respectively.

15. A device according to claim 11, wherein one of said pair of core members is I-shaped, and the other of said pair of core members is E-shaped.

16. A device according to claim 11, wherein the legs of the backside cover member are provided with convex portions, and the legs of the topside cover member are provided with leg openings to receive the convex portions of the backside cover member.

17. A device according to claim 16, wherein the convex portions includes a spherical curved surface and a flat retaining surface to be retained by an edge of the leg openings.

18. A device according to claim 12, wherein the projection is conical and includes inclined surfaces.

19. A device according to claim 11, wherein the backside core member is an EER-type core member including a cylindrical central core leg.

20. A device according to claim 11, wherein the backside core member is a UR-type core member including a such shaped section with two core legs, one of the core legs having a square pole-shaped and the other of the core legs having a cylindrical shape.

* * * * *